United States Patent [19]

Molenaar

[11] 4,240,236

[45] Dec. 23, 1980

[54] PROCESS FOR SETTING UP THE SHUTTERING FOR A BUILDING WALL, AND SETTING BLOCK TO BE USED IN THIS PROCESS

[75] Inventor: Adrianus Molenaar, Goes, Netherlands

[73] Assignee: Molenaar's Betonindustrie B.V., Netherlands

[21] Appl. No.: 932,101

[22] Filed: Aug. 9, 1978

[30] Foreign Application Priority Data

Aug. 9, 1977 [NL] Netherlands ..... 7708770

[51] Int. Cl.[2] ..... E04G 11/20

[52] U.S. Cl. ..... 52/741; 52/236.3; 249/22

[58] Field of Search ..... 52/741, 238; 249/18-25, 34

[56] References Cited

U.S. PATENT DOCUMENTS

| | | | |
|---|---|---|---|
| 2,775,807 | 1/1957 | Grover et al. | 249/22 |
| 3,473,778 | 10/1969 | Blonde | 249/19 |
| 3,524,293 | 8/1970 | Leyten et al. | 52/741 |
| 4,104,844 | 8/1978 | Brownlee | 249/19 |

FOREIGN PATENT DOCUMENTS

| | | | |
|---|---|---|---|
| 96374 | 6/1972 | France | 249/34 |
| 1076653 | 7/1967 | United Kingdom | 249/34 |

*Primary Examiner*—J. Karl Bell

*Attorney, Agent, or Firm*—Karl W. Flocks

[57] ABSTRACT

Setting block and process for setting up the shuttering for a building wall involving accurate positioning of the wall shuttering with an upwardly protruding positioning rod case in an underlying wall and after the floor shuttering has been placed, the placing the setting block so that its vertical bore grips around the rod.

6 Claims, 1 Drawing Figure

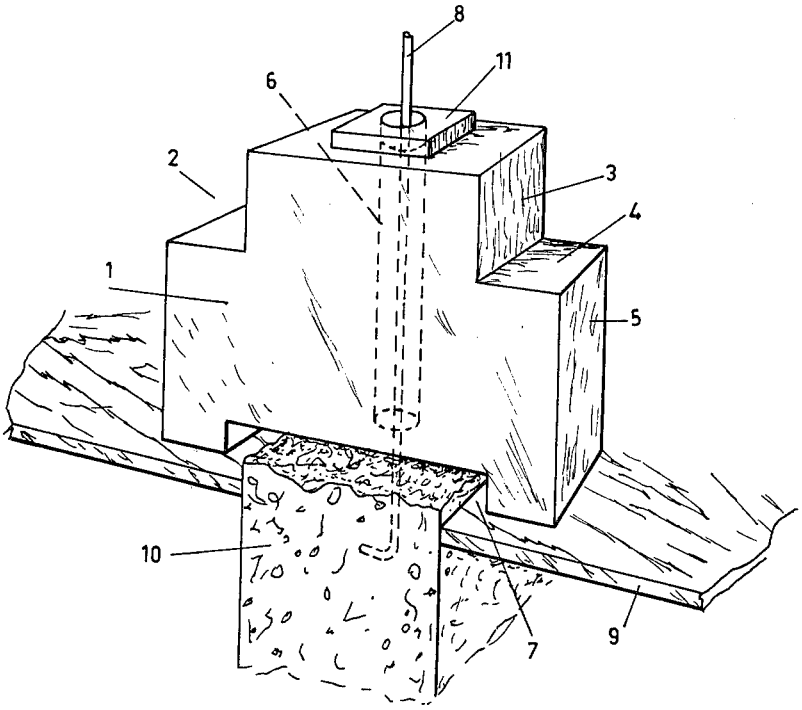
8
11
6
2
3
4
1
5
10
7
9

PROCESS FOR SETTING UP THE SHUTTERING FOR A BUILDING WALL, AND SETTING BLOCK TO BE USED IN THIS PROCESS

The invention relates to a process for setting up the shuttering or formwork for a building wall.

In buildings with continuing concrete floors, especially the setting up of the wall shuttering in line with the concrete walls of the floor beneath, on the cast floor causes major difficulties. In the first place, much and sometimes complicated measuring is necessary for finding the correct position, whereas maintaining these positions and manoeuvring with the wall shuttering or the parts thereof is very difficult to carry out on the draughty floors of buildings under construction.

The purpose of the present invention is to solve this problem in a simple way, in that for an accurate positioning of the wall shuttering a positioning rod, which protrudes upwards, is cast in the underlying wall or suchpart, and that after the floor wood form has been placed a setting block is placed on this shuttering, which setting block by a vertical bore therethrough grips around this rod. This process offers the possibility to place the setting block on the floor shuttering at the place of the underlying wall and to use it as a guide for the wall shuttering to be set up, the setting block being centred on the positioning rod, which may consist e.g. of a reinforcement rod, and further measuring becoming superfluous.

In order to be able to correct small position differences at the topside of the underlying walls, it is possible according to the invention that the central bore grips with a tolerance around the positioning rod and that the setting block is fixed on the rod by means of a rudder and a filling plate. By tightening the nut, the undoing of a once made correction will be impossible. The nut may be self-tapping.

For carrying out the process according to the invention, use can be made of a setting block, which consists of a concrete guide block to be placed on the floor shuttering, which block is provided centrally with a cylindrical bore, which can be covered by a plate.

It will then be possible to let the guide block be one with the floor to be cast and to that end, according to the invention, will preferably have at both sides a horizontal shoulder surface, the horizontal distance between these shoulder surfaces corresponding or approximately corresponding with the thickness of the wall to be cast, and the vertical distance to the underside of the block corresponding or approximately corresponding with the thickness of the floor to be cast. The shoulder surfaces enable an easy and accurate positioning of the wall shuttering, whereas they also indicate the exact floor height and thus can be used very efficiently for levelling the floor.

Preferably the upper end of the underlying concrete wall will already be above the level of the floor shuttering. To this end, it is possible according to the invention that a rectangular or almost rectangular recess is provided at the underside of the guide block, by which recess the guide block grips around the underlying wall. This embodiment also enhances the fixed position of the guide block.

The invention will be explained hereinafter with reference to the drawing, in which, by means of example, an embodiment of the guide block according to the invention is shown.

The shown guide block 1 consists of a rectangular block of concrete made with the required compression strength. The upper corners have at both sides a rectangular recess 2, of which the vertical walls 3 are provided at a distance from each other, which corresponds or almost corresponds with the thickness of the wall to be cast and which constitute a wall beginning or guide. On the horizontal surfaces 4 of these recesses there is enough space, if necessary, to support the wall shuttering.

The vertical lateral surfaces 5 of the guide block have a height, which corresponds or almost corresponds with the height of the floor to be casted. The block 1 centrally has a cylindrical all-through bore 6, which at the underside debouches into a rectangular recess 7, which at least spans the outside dimension of the underlying wall 10. However, the recess will preferably fit largely around the roughened topside of the wall, which protrudes some centimetres above the floor shuttering.

The total length of the shown guide block, for a floor thickness of 18 cm and a wall thickness of 20 cm, may be e.g. 35.8 cm by a height of 27.8 cm and a thickness of 9 cm. The diameter of the central bore 6 is e.g. 4 cm.

For using the guide block, an upwards protruding positioning rod 8 is cast in the topside of the already cast wall. After the encasing of the floor, where the floor shuttering 9 will usually continue up to the sides of the vertical wall 10, a guide block 1 is placed, possible with adding of some fresh concrete, at the topside of the wall 10 on the floor shuttering 9 on this positioning rod in the indicated way. Then a follower 11 is placed on the rod 8 and the block is fixed on the rod by means of a self-tapping nut and clamped against the floor shuttering. Possible deviations of the topside of the underlying wall or of the positioning rod can be corrected by sliding the block, of which the bore 6 fits largely around the rod 8. Thus a number of these guide blocks are anchored on this wall in the longitudinal direction thereof.

Subsequently the floor is cast, during which the blocks are embedded in this floor and the shoulder surfaces 4 can be maintained for the levelling. In connection with the expansion of the shuttering as a result of the wet concrete, the height of the vertical surface 5 is chosen slightly smaller, e.g. 2 mm, than the floor thickness, so that the floor will not become unnecessarily thicker.

After the setting of the concrete, the wall shuttering can be set against the vertical surfaces 3 of the wall beginning. To this end, the distance of these surfaces 3 has again been kept somewaht smaller (e.g. again 2 mm) than the wall thickness, for the above reason.

In this way both an accurate centering and an easy and correct setting of the wall shuttering at the right distance is assured, whereas the guide block also very much simplifies the maintaining of the floor thickness and the finishing of the floor surface, saves concrete, respectively.

I claim:

1. A method of accurately setting up a form for a wall of a storied building comprising the steps of casting an upwards protruding locating rod in an underlying wall, placing a floor form relative to said underlying wall, fixing a guide block with a vertical bore on said floor form and around said rod, casting the floor on said floor form, and attaching a wall form to said guide block.

2. The method of claim 1 further characterized by fixing said guide block on the rod by means of a nut and a filling plate, passing the locating rod with a tolerance through the centered vertical bore of said guide block, engaging the underlying wall with a tolerance in a bottom recess of said block.

3. A guide block for carrying out the method according to claim 1, said guide block comprising a rectangular concrete spacer block to be placed on a floor form, said spacer block having a cylindrical vertical bore, a setting plate for covering said vertical bore.

4. The guide block of claim 3, further characterized by a horizontal shoulder surface on both sides of said spacer block, the horizontal distance between said shoulder surfaces corresponding substantially to the thickness of the wall to be cast, the vertical distance from said horizontal shoulder surfaces to the bottom of said spacer block corresponding substantially with the thickness of the floor to be cast.

5. The guide block of claim 4, further characterized by said horizontal distance being less than the thickness of the wall to be cast, and said vertical distance being less than the thickness of the floor to be cast.

6. The guide block of claim 3, further characterized by said spacer block having a substantially rectangular bottom recess for receiving the underlying wall.

* * * * *